US006415842B1

(12) United States Patent
Vasilakes et al.

(10) Patent No.: US 6,415,842 B1
(45) Date of Patent: Jul. 9, 2002

(54) SYSTEM FOR PRINTING AND APPLYING TAPE ONTO SURFACES

(75) Inventors: Lloyd S. Vasilakes, Stillwater; Michael R. Mitchell, St. Paul, both of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/330,555

(22) Filed: Jun. 11, 1999

(51) Int. Cl.[7] ..... B32B 31/00; B65B 7/16

(52) U.S. Cl. ..... 156/387; 156/361; 156/468; 156/486; 156/522; 156/DIG. 4; 156/DIG. 49; 53/136.4; 101/484; 101/474; 226/152; 226/153; 226/156

(58) Field of Search ..... 156/468, 486, 156/475, DIG. 4, DIG. 2, DIG. 49, 387, 354, 521, 361, 360, 522, 277; 53/136.4; 226/156, 152, 153; 101/484, 474

(56) References Cited

U.S. PATENT DOCUMENTS

| | | | | |
|---|---|---|---|---|
| 2,532,011 | A | 11/1950 | Dahlquist et al. | 428/40.1 |
| 2,607,711 | A | 8/1952 | Hendricks | 428/41.5 |
| 2,990,081 | A | 6/1961 | De Neui et al. | 156/519 |

(List continued on next page.)

FOREIGN PATENT DOCUMENTS

| | | |
|---|---|---|
| DE | 3 727 667 | 3/1989 |
| DE | 195 35 535 | 3/1997 |
| DE | 1 960 9431 | 9/1997 |
| EP | 0 096 841 | 12/1983 |
| EP | 0 170172 | 2/1986 |
| EP | 0 579 423 | 1/1994 |
| EP | 0 579 430 | 1/1994 |
| EP | 0 613 787 | 9/1994 |
| EP | 0 673 839 | 9/1995 |
| EP | 0 688 008 | 12/1995 |
| EP | 0 397 379 B1 | 9/1996 |
| EP | 0 763 471 | 3/1997 |
| EP | 0 854 051 A1 | 7/1998 |
| EP | 00 905 210 | 3/1999 |
| GB | 2 243 135 | 10/1991 |
| GB | 2 325 453 | 11/1998 |
| JP | 10-101043 | 4/1998 |
| WO | 92/07347 | 4/1992 |
| WO | 93/09195 | 5/1993 |
| WO | 95/21224 | 8/1995 |
| WO | 95/31800 | 11/1995 |
| WO | 96/21557 | 7/1996 |
| WO | WO 96/40508 | 12/1996 |
| WO | 97/43744 | 11/1997 |
| WO | 97/46389 | 12/1997 |
| WO | 99/13015 | 3/1999 |
| WO | 99/20468 | 4/1999 |

OTHER PUBLICATIONS

US 4,909,885, 03/1990, Swenson (withdrawn)

John Wiley & Sons, *Encyclopedia of Polymer Science and Engineering,* vol. 13 (1998).

*Encyclopedia of Polymer Science and Technology,* vol. 1 (1964).

U.S application No. 09/207,801, Faust et al., filed Dec. 9, 1998.

N. Draper & H. Smith, *Applied Regression Analysis,* 2nd Ed., Chapters 2 and 6 (1966).

Bill Meyer & Saltzman, *Principles of Color Technology,* 2nd Ed., pp. 62–65 (1981).

Irving Skeist, *Handbook of Adhesives,* 2nd Ed., p. 102 (1977).

*Research Disclosure,* Nov. 1994, No. 367.

*Primary Examiner*—Linda Gray
(74) *Attorney, Agent, or Firm*—Melissa E Buss

(57) ABSTRACT

A tape handling system including a tape mount roller, a first accumulator movable between first and second positions, a printer for printing on tape, and a second accumulator movable between first and second positions. Movement of the second accumulator from the first position to the second position causes the printer to begin printing. An apparatus including the tape handling system and a tape applicator.

34 Claims, 4 Drawing Sheets

U.S. PATENT DOCUMENTS 3,318,852 A 5/1967 Dixon ..... 428/341
3,502,497 A 3/1970 Crocker ..... 428/311.11
3,561,190 A 2/1971 Derenthal ..... 53/67
3,625,794 A 12/1971 Arikawa et al. ..... 156/244.23
3,657,051 A * 4/1972 McCarthy ..... 156/384
3,905,859 A 9/1975 Patterson ..... 156/443
3,963,557 A 6/1976 Patterson ..... 156/519
4,001,072 A 1/1977 De Neui ..... 156/461
4,072,224 A 2/1978 Baranby et al. ..... 400/124.11
4,161,138 A 7/1979 Marchetti ..... 493/117
4,200,483 A 4/1980 Hoveler ..... 156/487
4,241,198 A 12/1980 Kobayashi ..... 525/360
4,256,528 A 3/1981 Patterson ..... 156/514
4,321,103 A 3/1982 Lindstrom et al. ..... 156/351
4,388,143 A 6/1983 Buchholz et al. ..... 156/415
4,421,817 A 12/1983 Pina et al. ..... 428/207
4,577,199 A 3/1986 Saiki et al. ..... 347/215
4,676,859 A 6/1987 Cleary, Jr. et al. ..... 156/361
4,707,211 A 11/1987 Shibata ..... 156/354
4,717,621 A 1/1988 So et al. ..... 428/349
4,728,571 A 3/1988 Clemens et al. ..... 428/352
4,784,714 A 11/1988 Shibata ..... 156/354
4,807,177 A 2/1989 Ward ..... 364/900
4,815,871 A 3/1989 McGourty et al. ..... 400/120.16
4,839,742 A 6/1989 Nakatani et al. ..... 358/296
4,857,134 A 8/1989 Lin ..... 156/385
4,942,212 A 7/1990 Hanada et al. ..... 522/28
5,032,460 A 7/1991 Kantner et al. ..... 428/427
5,037,219 A 8/1991 Duport ..... 428/411.1
5,040,461 A 8/1991 Van-Ocker ..... 101/288
5,053,436 A 10/1991 Delgado ..... 521/64
5,168,814 A 12/1992 Kuzuya et al. ..... 101/487
5,193,926 A 3/1993 Kuzuya et al. ..... 400/719
5,202,190 A 4/1993 Kantner et al. ..... 428/447
5,209,808 A 5/1993 Booth ..... 156/487
5,214,119 A 5/1993 Leir et al. ..... 528/28
5,227,002 A 7/1993 Faust et al. ..... 156/468
5,242,888 A 9/1993 Atherton et al. ..... 503/227
5,261,996 A 11/1993 Rossini ..... 156/521
5,286,682 A 2/1994 Jacobs et al. ..... 501/34
5,290,615 A 3/1994 Tushaus et al. ..... 428/41.4
5,292,713 A 3/1994 Stenzel et al. ..... 503/226
5,295,753 A 3/1994 Godo et al. ..... 400/612
5,302,034 A 4/1994 Kitazawa ..... 400/615.2
5,308,173 A 5/1994 Amano et al. ..... 400/29
5,328,754 A 7/1994 Yuyuama et al. ..... 428/212
5,354,588 A 10/1994 Mitchell et al. ..... 428/41.6
5,356,706 A 10/1994 Shores ..... 428/352
5,376,418 A 12/1994 Rogers et al. ..... 428/41.7
5,399,036 A 3/1995 Yamaguchi ..... 400/236
5,419,648 A 5/1995 Nagao et al. ..... 400/208
5,425,823 A 6/1995 Woodside, III ..... 156/64
5,431,763 A 7/1995 Bradshaw ..... 156/256
5,443,318 A 8/1995 Kitazawa ..... 400/120.01
5,461,133 A 10/1995 Hammar et al. ..... 528/10
5,478,880 A 12/1995 Shipston et al. ..... 524/527
5,487,337 A 1/1996 Uland ..... 101/288
5,494,360 A 2/1996 Watanabe et al. ..... 400/83
5,497,701 A 3/1996 Uland ..... 101/288
5,503,485 A 4/1996 Nakazato ..... 400/613
5,524,996 A 6/1996 Carpenter et al. ..... 400/621
5,540,369 A 7/1996 Boreali et al. ..... 225/4
5,543,192 A 8/1996 Shipston et al. ..... 428/40.6
5,560,293 A 10/1996 Boreali et al. ..... 101/66
5,569,515 A 10/1996 Rice, II et al. ..... 428/29
5,571,617 A 11/1996 Cooprider et al. ..... 428/341
5,614,928 A 3/1997 Matsuda ..... 347/2
5,621,020 A 4/1997 Khatib et al. ..... 522/99
5,621,030 A 4/1997 Shipston et al. ..... 524/157
5,658,647 A 8/1997 Magill et al. ..... 428/195
5,661,099 A 8/1997 Mitchell, Jr. ..... 503/201
5,674,345 A 10/1997 Nash ..... 156/264
5,674,626 A 10/1997 Khatib et al. ..... 428/477
5,675,369 A 10/1997 Gaskill ..... 347/171
5,692,896 A 12/1997 Pospisil et al. ..... 433/8
5,750,004 A 5/1998 Wurz et al. ..... 156/360
5,750,630 A 5/1998 Sengupta ..... 528/59
5,782,496 A 7/1998 Casper et al. ..... 283/81
5,832,827 A 11/1998 Pistro et al. ..... 101/288
5,857,789 A 1/1999 Day et al. ..... 400/615
5,874,499 A 2/1999 Shipston et al. ..... 524/506
6,049,347 A 4/2000 Ewert et al. ..... 347/215
6,067,103 A * 5/2000 Ewert et al. ..... 347/171

* cited by examiner

SYSTEM FOR PRINTING AND APPLYING TAPE ONTO SURFACES

TECHNICAL FIELD

The present invention relates to tape. More particularly, the present invention relates to printing on tape and applying the tape onto surfaces.

BACKGROUND OF THE INVENTION

Containers, packages, cartons, and cases, (referred to as "boxes") for storing and shipping products typically use box sealing tape, an adhesive tape, to secure the flaps or covers so that the box will not accidentally open during normal shipment, handling, and storage. Box sealing tape maintains the integrity of a box throughout its entire distribution cycle. Box sealing tape can be used on other parts of boxes and on other substrates and can be used to function similarly to labels. These tapes can be made in roll or pad form. They can be transparent, translucent, or opaque, and can have information printed or otherwise applied to the tape.

These boxes generally contain information about the contents. This information, most commonly located on the box, might include lot numbers, date codes, product identification information, and bar codes. The information can be placed onto the box using a number of methods. These might include preprinting the box when it is manufactured, printing this information onto the box at the point of use with an inkjet coder that sprays a pattern of ink dots to form the image, or by using a flexographic ink rolling coder system. Other approaches include the use of labels, typically white paper with preprinted information either applied manually, or with an online automatic label applicator.

A recent trend in conveying information related to the product is the requirement to have the information specific for each box. For example, each box could carry specific information about its contents and the final destination of the product, including lot numbers, serial numbers, and customer order numbers. The information is typically provided on labels that are customized and printed on demand at the point of application onto the box. This is typically known as the ability to print "variable" information onto a label before it is applied onto the box. Two patents that disclose printed labels are U.S. Pat. Nos. 5,292,713 and 5,661,099.

One system for printing variable information involves thermal transfer ink printing onto labels using an ink ribbon and a special heat transfer printing head. A computer controls the printing head by providing input to the head, which heats discrete locations on the ink ribbon. The ink ribbon directly contacts the label so that when a discrete area is A heated the ink melts and is transferred to the label. Another approach using this system is to use labels that change color when heat is applied (thermal labels). In another system, variable information is directly printed onto a box by an inkjet coder. A computer can control the ink pattern sprayed onto the box or onto a label.

Both thermal transfer and inkjet systems produce sharp images. Inkjet systems include piezo, thermal, continuous, and drop-on-demand. With both inkjet and thermal transfer systems, the print quality depends on the surface on which the ink is sprayed. It appears that the best system for printing variable information is one in which the ink and the print substrate can be properly matched to produce a repeatable quality image, especially bar codes, that must be read by an electronic scanner with a high degree of reliability.

A variety of applying systems are available that incorporate a printing system, computer-controlled heated printing head, and guiding systems for the thermal transfer ink ribbon label and the liner. The PA/4020 Dual Panel Printer/Applicator made by Diagraph Corp. (Earth City, Mo.), the 2138 Printer/applicator made by Label-Aire Inc. (Fullerton, Calif.), and the 2800 Print/apply corner applicator made by Labeling Systems, Inc. (Oakland, N.J.) are some examples. These systems print on linered labels. The liner is the carrier for the label material. These systems print discrete messages onto the label, strip the label from its liner, and transfer the printed label onto a box. Although there are other materials available, such as polyesters, from which labels can be made, paper labelstock is the most popular because of its ready acceptance of thermal transfer ink and its low cost.

Minnesota Mining and Manufacturing Company of St. Paul, Mn. (3M) has sold an automatic system for applying pre-printed tape (with non-variable information) with bar codes since 1994 (Model Nos. TA1340, TA1341, and TA1342). This system can apply a corner label onto a box while the box is conveyed through a case sealer, or it can apply pre-printed tape onto a flattened box before the box is opened. This system offers an inexpensive, simple alternative to linered labels.

Printable tapes for applying on boxes, such as those disclosed in U.S. Pat. Nos. 4,421,817, 5,242,888, 5,354,588, 5,478,880, and 5,560,293, are known. However, these tapes are not capable of sealing boxes and receiving printed information of very high quality.

A system that can print variable information onto tape and apply the tape onto boxes is disclosed in U.S. application Ser. No. 09/207,801, assigned to 3M. This patent application describes a system for printing variable information on tape and applying it to boxes.

There is a need for a system that can permit information to be printed on a set location over and over; registering the printed information on each tape segment. There is also a need for a system in which the unwind tension of the tape can be controlled as the tape is removed from the tape roll to present the tape to a printer at a substantially uniform speed with minimal jerkiness.

SUMMARY OF THE INVENTION

The invention is an apparatus for printing information on a tape from a tape roll to form a tape segment, for applying the tape segment onto an object, and for cutting the tape segment. The apparatus includes a printer for printing information onto the tape. The printed tape segment is transported to a location for application onto the object. The tape segment is applied to the object and cut.

The apparatus can control the unwind tension of the tape as the tape is removed from the tape roll. This presents the tape to the printer at a substantially uniform speed and reduces jerkiness of the tape as the tape passes through the printer. Unwind tension can be controlled by prestripping the tape from the tape roll, such as by using a powered means for unwinding the tape from the tape roll.

The apparatus can also register the information to be printed on the tape with a specific location on the tape. This allows specific printed information to be automatically placed at the same location on different tape segments regardless of variations in the lengths of the tape segments, regardless of variations in the length of the surface on which the tape segments are applied, and regardless of variations in the printed material on each tape segment. Registration can include feeding unprinted tape, as necessary, to assist registration.

The apparatus can transport the tape segment to be applied to perform next tape segment out application. The apparatus can be part of a case sealing apparatus for sealing boxes using tape.

The object onto which the tape segment is to be applied can be a box having sides, corners, and seams along which the box is sealed. The tape segment can be applied onto at least one of the sides, the corners, and the seams of the box. Also, the tape segment can be applied along at least one of the seams of the box to seal the box with a tape segment that is printed with information that can be variably printed. This tape segment can maintain the box closed during shipping and handling.

The printer can use direct thermal printing, thermal transfer printing, inkjet printing, or laser printing.

DETAILED DESCRIPTION

Figure 1:
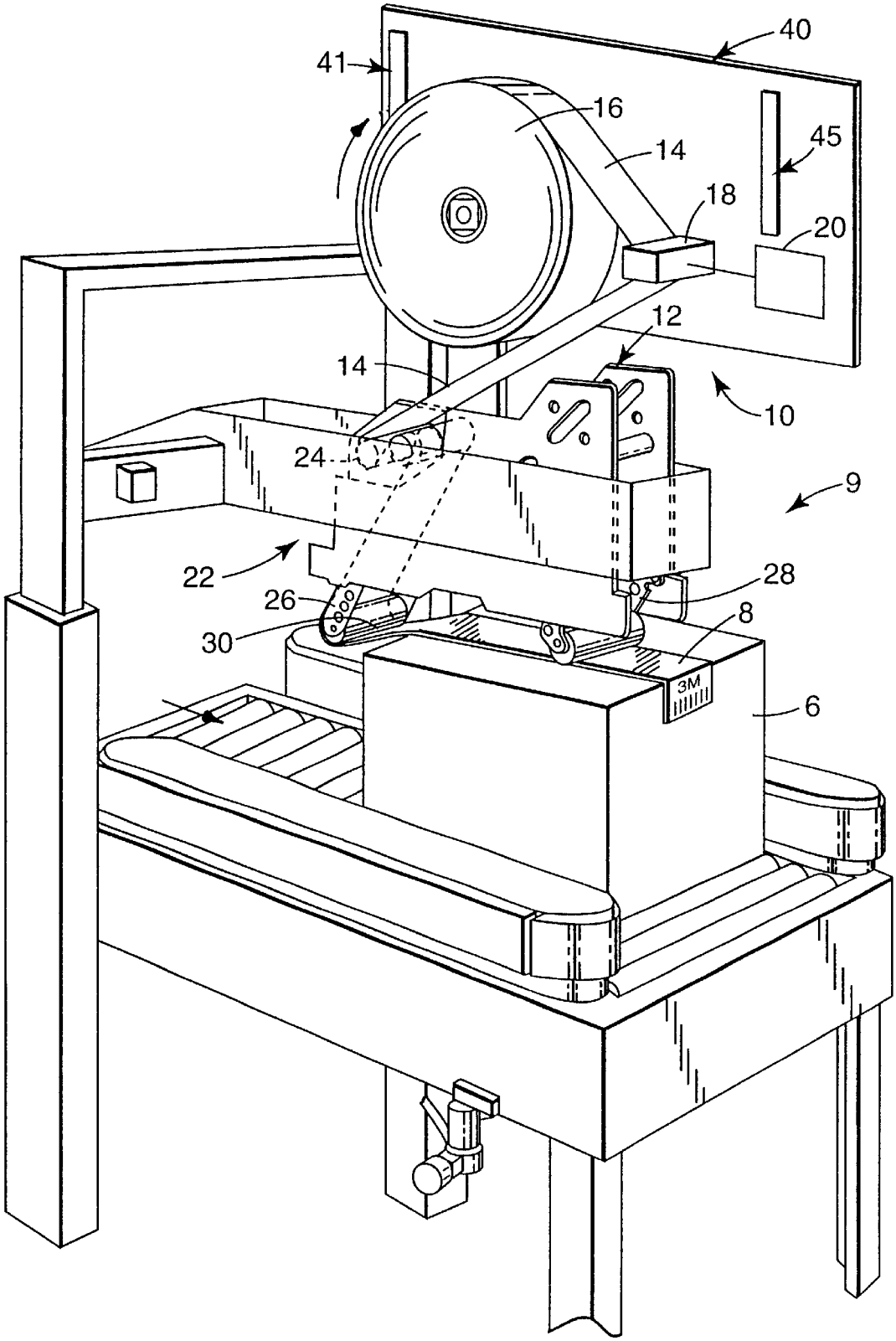
FIG. 1 is a schematic view of a tape handling system and case sealer of the present invention.

The invention includes a system for printing information on a tape. The tape can be applied to a surface of an object, such as a container, like a box or case. Throughout this description, the term "tape" generally means a substrate that is linerless (although a lined substrate can also be used); that can be supplied in a roll (such as a self-wound roll) or other form; and that is not precut. The term "tape segment" is used to mean a portion of tape that can convey information (such as by printing) and that can be affixed to a surface. Tape segments include the tape after it is printed (if it is to be printed), both before and after it is severed from the rest of the tape. The term "variable" printing means printing customized information on demand to form a tape segment. Information is any information, including words, symbols, graphics, symbols, and bar codes.

The system of this invention prints information onto a tape to form a tape segment, and can optionally vary the information placed on each tape segment to allow for an infinite variation of content and lengths to be produced from one supply roll of tape. The system can apply the printed tape segment onto a box either while the box is stationary or while the box is moving (such as while the box is being closed and sealed). The system can apply the tape segment on a side of the box to serve as a conveyor of information. Alternatively, it can apply the tape segment as an L-clip onto the corner of the box or a C-clip along a seam of the box to convey information, to serve as a box closure device (without print), or a combination conveyor of information and box closure device.

The invention improves recyclability of used boxes, reduces the amount of material required to provide a tape segment carrying variable information, and can combine sealing the box and providing information than current labeling systems. The system can automatically apply the tape segment onto boxes, as discussed above, or the printed tape segment can be dispensed for manual application.

The tape can be a single-coated pressure sensitive adhesive tape having a multiple layer construction. The backing layer can be, for example, a single or multiple layer plastic film backing. Suitable plastic film backings include polypropylene, polyethylene, copolymers of polypropylene and polyethylene, polyvinyl chloride (PVC), polyesters, and vinyl acetates. The polypropylene can include monoaxially-oriented polypropylene (MOPP), biaxially oriented polypropylene (BOPP), or sequentially or simultaneously biaxially oriented polypropylene (SBOPP). The backing material can be compostible, degradable, colored, printed, and can be of different surface textures or embossed. Pressure sensitive adhesive is coated onto one side of the backing and a release coating (a low adhesion backsize (LAB) coating) is optionally coated on the opposite side to allow the tape to unwind from itself when wound in a roll.

Because certain release coatings on pressure sensitive adhesive tapes are not intended to be printed, the ink may not securely anchor because it is poorly bonded to the surface of the release coating. The ink may be easily scuffed, marred, or distorted under normal use conditions. The release coating on the tape of the invention can accept ink, such as from a flexographic process or from a thermal transfer method. The release coating can prevent dirt from adhering in the pores of the film layer and affecting the scannability of the tape. Using a compatible ink transfer ribbon onto the release coating can provide sufficiently high anchorage levels such that the ink can not be scuffed off. The release coating composition can be compatible with the adhesive composition and does not degrade the adhesive properties of the tape such as by being transferred to the adhesive composition.

Release coating compositions for the LAB layer of tapes in roll form may include silicone, alkyl, or fluorochemical constituents, or combinations as the release-imparting component. Useful release coating compositions for the invention include silicone containing polymers, such as silicone polyurethanes, silicone polyureas and silicone polyurethane/ureas, such as those described in U.S. Pat. Nos. 5,214,119, 5,290,615, 5,750,630, and 5,356,706, and silicone acrylate grafted copolymers described in U.S. Pat. Nos. 5,032,460, 5,202,190, and 4,728,571. Other useful release coating compositions include fluorochemical-containing polymers such as those described in U.S. Pat. No. 3,318,852, and polymers containing long alkyl side chains such as polyvinyl N-alkyl carbamates (e.g., polyvinyl N-octadecyl carbamates) as described in U.S. Pat. No. 2,532,011, and copolymers containing higher alkyl acrylates (e.g., octadecyl acrylate or behenyl acrylate), such as those described in U.S. Pat. No. 2,607,711, or alkyl methacrylates (e.g., stearyl methacrylate) such as those described in U.S. Pat. Nos. 3,502,497 and 4,241,198, where the alkyl side chain includes from about 16 to 22 carbon atoms.

These release polymers can be blended with each other and with thermosetting resins or thermoplastic film forming polymers to form the release coating composition. In addition, other additives may be used in the release coating compositions such as fillers, pigments, wetting agents, viscosity modifiers, stabilizers, anti-oxidants, and cross-linking agents.

Numerous other layers can be added to the tape, such as primers to increase adhesive layer adhesion to the backing layer. Also, printed material can be located on the first side of the backing layer under or over the adhesive, or on the second side of the backing layer under or over any LAB layer. This printed material can be any information like advertising or instructions. Also, an additional flood layer of ink or similar coating can be used to alter the opacity of the tape. The tape could contain deodorants, perfumes, antistatic materials, and encapsulated cleaning chemicals. Also, the release properties of the backing can be modified such that the backing and the adhesive cooperate to achieve desired unwind characteristics. The release properties of the backing can be modified by applying a low surface energy composition, priming, corona discharge, flame treatment, roughening, etching, and combinations.

Many types of adhesives can be used. The adhesive can include hotmelt-coated formulations, transfer-coated formulations, solvent-coated formulations, water-based, and latex formulations. Examples of adhesives useful in the invention include those based on general compositions of polyacrylate; polyvinyl ether; diene-containing rubber such as natural rubber, polyisoprene, and polyisobutylene; polychloroprene; butyl rubber; butadiene-acrylonitrile polymer; thermoplastic elastomer; block copolymers such as styrene-isoprene and styrene-isoprene-styrene block copolymers, ethylene-propylene-diene polymers, and styrene-butadiene polymer; poly-alpha-olefin; amorphous polyolefin; silicone; ethylene-containing copolymer such as ethylene vinyl acetate, ethylacrylate, and ethyl methacrylate; polyurethane; polyamide; epoxy; polyvinylpyrrolidone and vinylpyrrolidone copolymers; polyesters; and mixtures of the above. Additionally, the adhesives can contain additives such as tackifiers, plasticizers, fillers, antioxidants, stabilizers, pigments, diffusing particles, curatives, and solvents.

Useful adhesives include pressure sensitive adhesives. Pressure sensitive adhesives are normally tacky at room temperature and can be adhered to a surface by application of, at most, light finger pressure. A general description of useful pressure sensitive adhesives may be found in *Encyclopedia of Polymer Science and Engineering*, Vol. 13, Wiley-Interscience Publishers (New York, 1988). Additional description of useful pressure sensitive adhesives may be found in *Encyclopedia of Polymer Science and Technology*, Vol. 1, Interscience Publishers (New York, 1964).

The invention can be used in combination with conventional printing systems or with the unique variable print and apply system, such as described in U.S. application Ser. No. 09/207,801. The length of the tape segment for each application can be varied using a mechanism triggered by a mark seen by a detector. (Conventional systems use a die cut label on a liner, which requires the customer to determine what label size is needed, and stock this size label for each application.) An infinite number of different tape segment lengths can be created using a single input roll of tape. The length of the tape segment can depend on where a registration mark is printed. This allows not only printing variable information onto the tape, but also adjusting each tape segment length to match the requirements of the printed message. The tape segment width remains constant from the same supply roll source.

Tape can be printed and applied to any surface of a box in several ways, and the system can be mounted to a case sealer. The printer 18 prints the desired information on the tape 14 to form tape segments. The printer 18 can be an off-the-shelf printer, such as Model PE42 from Datamax Corporation (Orlando, Fla.), or a similar printer or print engine with or without modification, mounted onto the case sealer 9. A controller 20 tells the printer 18 what to print on the tape 14 and how long the tape segments should be.

After printing, an applying mechanism 22 applies the tape segment onto a surface of the box 6, either before or after cutting the tape segment 8. The applying mechanism 22 can include an accumulator 24, which can include a dancer arm 26, and an applicator arm 28. The dancer arm 26 can provide the amount of tape 14 necessary to make up for the difference in speed between the case sealer 9 (25.4–50.8 cm/s (10–20 in/s)) and the printer 18 (5.1–30.5 cm/s (2–12 in/s), depending on such characteristics as the resolution, the length of the tape segment, the type of ribbon, and the brand of printer). Also the dancer arm 26 can keep the tension essentially uniform at the output of the printer 18 to eliminate inaccuracies caused by overpulling the tape 14. Alternatively, the case sealer 9 could run at the same speed as the printer so that no dancer arm 26 is needed. An alternative to the dancer arm 26 is an open loop system (not shown), where the tape 14 is fed out of the printer 18, hangs down to form a loop, then travels to the taping head. A detector, such as a photosensor determines when the minimum loop is reached and allows the printer 18 to resume printing.

After leaving the dancer arm 26 (or open loop), the printed tape 14 (as tape segments) moves to the applicator arm 28. When a box 6 being conveyed through the case sealer 9 contacts the applicator arm 28 on which the tape segment resides, the printed tape segment adheres to the box 6. The motion of the box 6 causes the applicator arm 28 to pivot to apply the tape segment along one side of the box 6. For an L-clip, when the roller on the applicator arm 28 reaches the corner of the box 6 it rolls around the corner and applies the same piece of tape around the corner and to the adjacent side of the box 6. For a C-clip, tape is applied to the front, top, and bottom of the box 6. This method can be used on the upper taping head, the lower taping head, or on side mounted heads.

The tape segment is severed by a cutting mechanism (not shown). In one embodiment, when a registration mark (printed along with required tape segment information) passes by a detector, such as a photosensor, an air cylinder is actuated, causing the applicator arm 28 to retract and change the tape path. The new tape path crosses the plane of the cutting mechanism. Continued movement of the box 6 causes the tape segment to be cut, and the box continues until it exits the machine. When the photosensor is clear, the air cylinder returns to its home position. The printer 18 prints as preset independent of the application process. In another embodiment, the tape is cut by a standard cutoff mechanism present in known taping heads.

In another embodiment, a flat surface applicator (FSA) can be used to apply tape to the sides of boxes. A printer and dancer arm are in the web path before the applicator. With this system, one or more tape segments of varying length and information can be applied to the same side of a box. A registration mark on the tape determines the length of the tape segment. A mark on the box or timer initiates the application.

Vacuum pad, vacuum belt, and vacuum wheel systems also can be used. In a vacuum wheel system, after the tape is printed, it is captured by the vacuum wheel and the tape segment is cut. The vacuum wheel rotates or moves on an arm, as necessary, to position the tape segment. The wheel moves between a first position in which the wheel receives the tape segment 8 and a second position in which the tape segment 8 is applied onto a surface, such as a box. The controller can be used to govern when the vacuum wheel is moved to the second position to apply the tape segment, for how long the vacuum wheel resides adjacent the surface, and when the vacuum wheel returns to the first position to receive another tape segment. This system can be adapted to apply both side tape segments as well as corner tape segments.

The system can be used to print information onto the pressure sensitive adhesive tape that also seals the box. This eliminates the need for a secondary information-bearing tape segment. This reduces the amount of tape that is used and eliminates a major sub-component of the case sealer. This tape, therefore, must combine the required sealing properties with the property of being able to receive and hold ink. Also, information can be applied on the portion of the tape which forms the leg of the seal on the side of the box so that it can be read (or scanned) without having to see the top of the box.

In varying the length of tape 14, or in using substantially the same length of tape 14 (with the same or different information printed on the tape) to create a tape segment 8, it may be necessary to control the length of the tape to make sure that each tape segment has the information in the proper (same) location on the box 6. This requires registering the printed information on the tape segment and is discussed below as the registration aspect of the invention.

With many tapes, such as with linerless label stock, there is a tradeoff between easy, smooth unwind of the tape from its roll and print anchorage. If a release layer is used that requires a sufficiently low unwind force to permit smooth and easy unwind, the thermal transfer ink will not adhere to the tape. Generally, a silicone or other release agent is applied to the tape backing opposite the adhesive to reduce adhesion between the adhesive and the backing and to create a smooth, non-jerky unwind. Inks do not adhere well to certain types of release agents. However, release agents that permit good ink adherence or anchorage to the tape do not allow the tape to unwind smoothly. If the tape is jerky as it unwinds, it will be jerky as it travels through the printer, causing defects in the printed information. This is important particularly when printing bar codes and other precise information. This is addressed by the unwind aspect of the invention in which tape with a printable release agent coating can be used in thermal transfer printers. The tape construction can be optimized to provide the best quality print because the unwind characteristics are not a concern.

Figure 2:
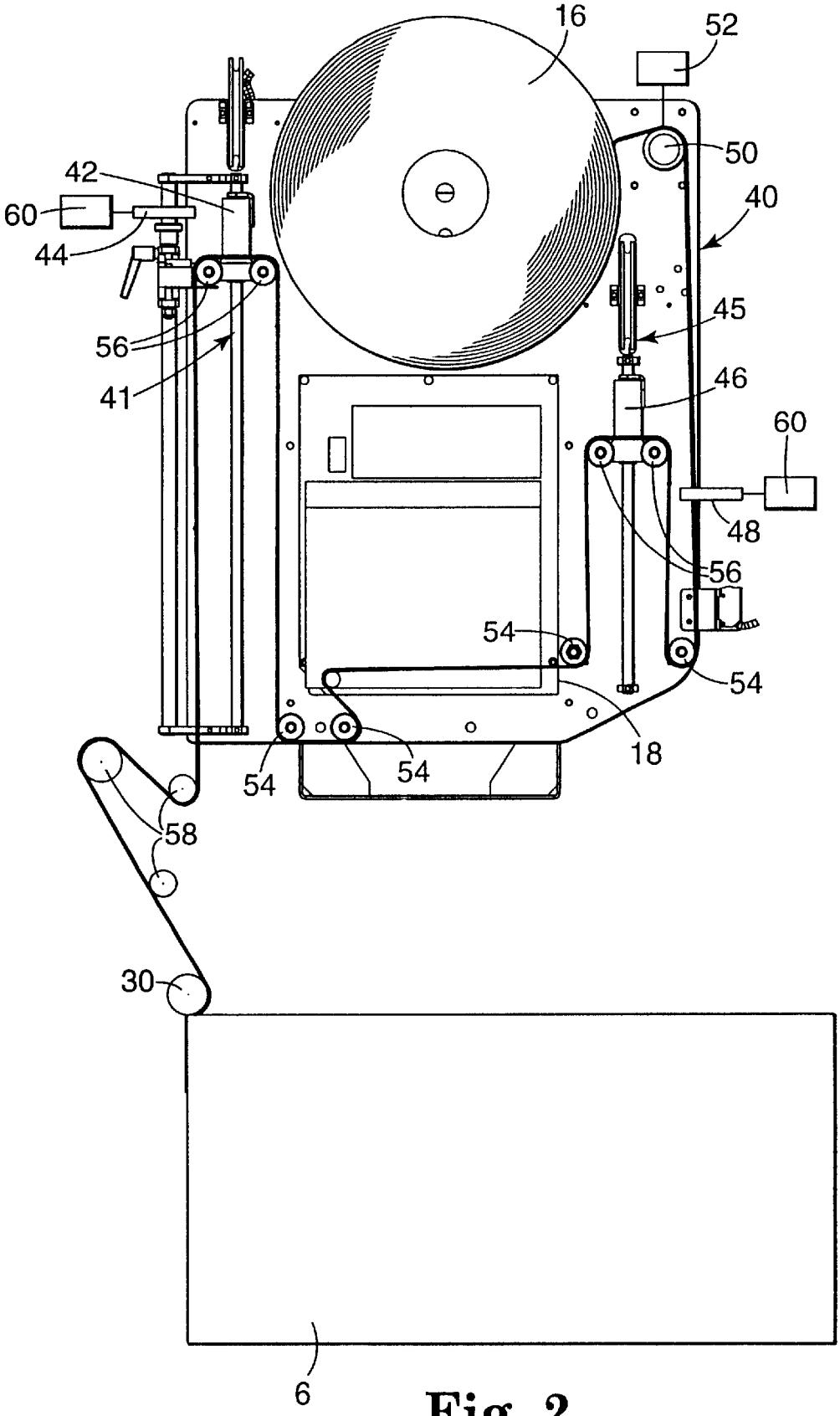
FIG. 2 is a schematic view of the tape handling system in a first position.
Figure 3:
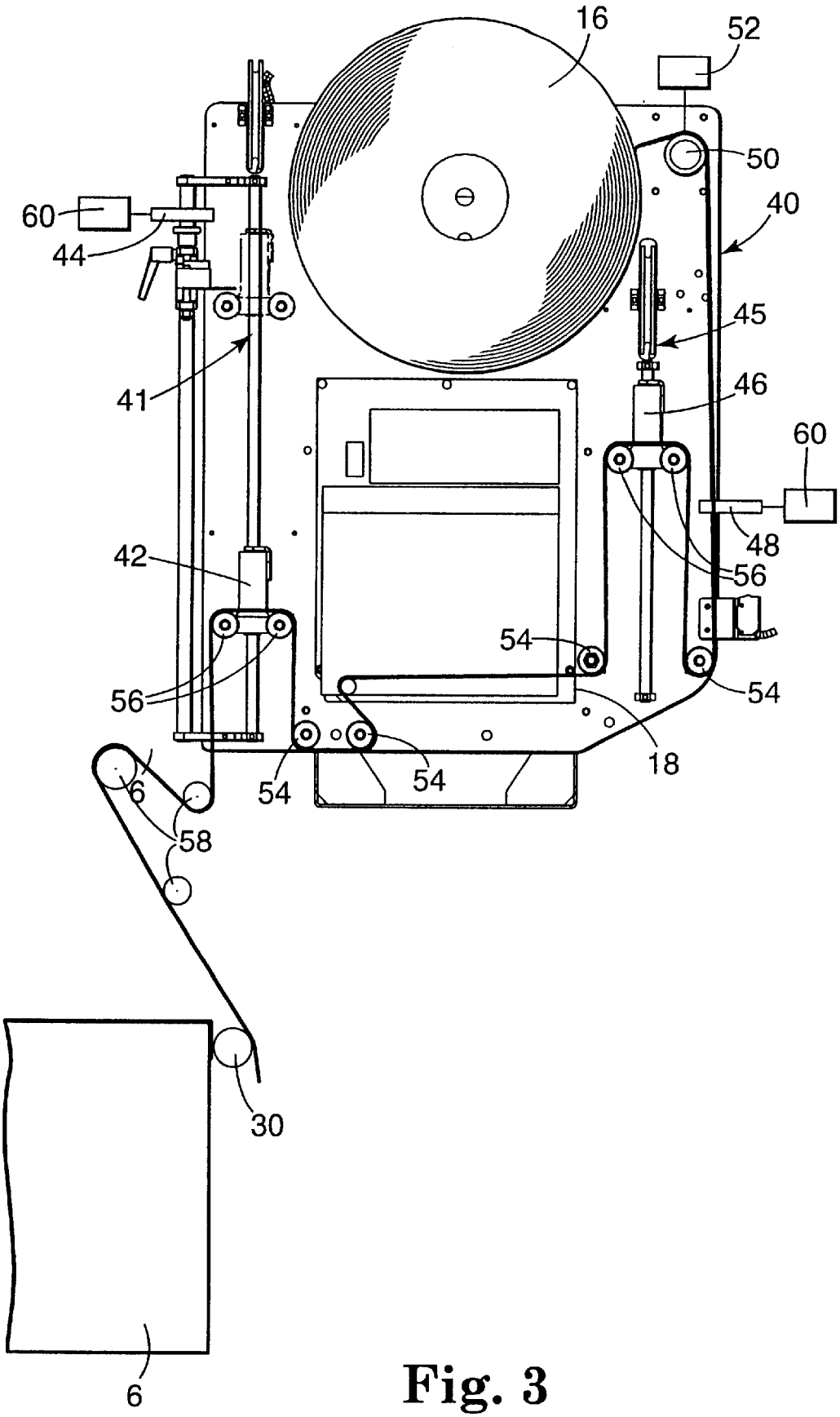
FIG. 3 is a schematic view of the tape handling system in a second position.
Figure 4:
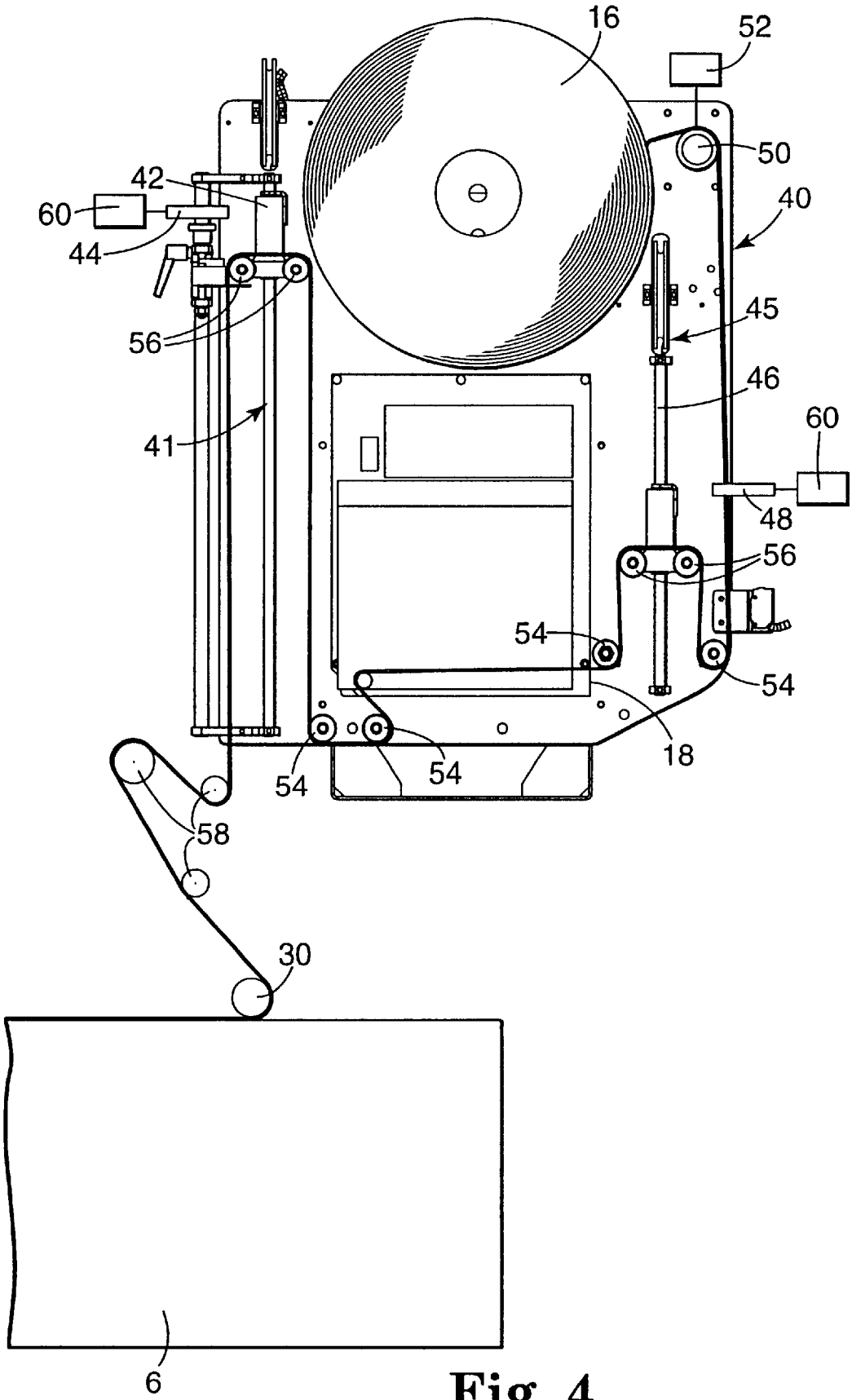
FIG. 4 is a schematic view of the tape handling system in a third position.

FIGS. 2–4 schematically show the system which meets both aspects of the invention. The tape delivery system 40, which can be on a plate on a frame, uses an open loop control system to register the print on the tape segment 8. This system 40 receives tape 14 from a tape supply such as a supply roll 16 mounted on a tape mount roller and feeds it to the printer 18. From the printer 18, the tape 14 travels to the taping head of the case sealer 9. A second accumulator carriage 42 is located between the printer 18 and taping head. The second accumulator carriage 42 is part of a second accumulator 41. At least one sensor 44 is located to detect motion of the first accumulator carriage 42.

The system 40 also allows a tape with jerky unwind characteristics to travel smoothly through the printer. The system 40 includes a first accumulator carriage 46, called a supply side accumulator carriage,and a first sensor 48. The first accumulator carriage 46 is part of a first accumulator 45. A prestrip roller 50, driven by a motor 52 or other driver, can pull tape 14 from the supply roll 16. A mechanical arm, powered by an air cylinder or other device, can be used instead of the motor to assist prestripping. A series of idler rollers 54 are located along the tape path to guide the tape 14. The path of the tape 14 from the supply roll 16 to the taping head, as shown in the Figures, is as follows. The tape 14 from the supply roll 16 passes around the prestrip roller 50 and around an idler roller 54. It then passes through the first accumulator carriage 46,which itself can include rollers 56, and around another idler roller 54. Next, it passes through the printer 18, around one or more additional idler rollers 54, through the second accumulator carriage 42, which itself can include rollers 56, and around additional guide rollers 58 on the way to the taping head. The number and location of the idler rollers 54 and the guide rollers 58 can be varied as necessary to accommodate the configuration of both the system 40 and the case sealer 9.

This system 40 allows a continuous length of tape 14 which is used to seal a box 6, and which can be applied in any manner, to be printed and applied to the box such that the printed information appears in substantially the same location on each box. For example, a product description and bar code could be printed on each end panel tape leg (see FIG. 1) so that it can be seen when stacked on a pallet for shipping.

The registration aspect of the system 40 operates as follows. In the starting position shown in FIG. 2, tape 14 is on the applying roller 30, and a box is fed into case sealer 9 and contacts the tape 14 on the taping head. This pulls tape 14 from the second accumulator 41 which causes the second accumulator carriage 42 to be pulled down, from a first position as shown in FIG. 2 to a second position as shown in FIG. 3, to supply the tape to the box.

Upon detecting the downward motion of the second accumulator carriage 42, the second sensor 44 sends a signal to a controller 60, such as a programmable logic controller (PLC), which sends a signal to the printer 18 to tell the printer to start printing. The printer 18 prints the required information to create a tape segment of a predetermined length. The length of the printed material should be slightly less than the average tape application length onto the box so that the printing does not extend to the edge of the tape segment 8.

The taping head applies a previously-printed tape segment to the box 9 and cuts it off in any suitable manner. After the tape is applied to the box, the second accumulator 42 moves upwardly toward its starting position. (The printer 18 is still printing.) After the printer 18 finishes printing, the printer sends a signal to the controller 60. If the second sensor 44 does not detect the second accumulator carriage 42 because the carriage has not returned to its original position (shown in borken line FIG. 3), the controller 60 sends a signal to the printer 18 to slew (feed without printing) tape 14 until the second sensor 44 detects the second accumulator carriage 42 returned to its starting position shown in FIG. 2.

In the unwind feature of the present invention, the tension of tape through the printer is controlled to allow tape that has good ink adherence characteristics and jerky unwind characteristics to have precise information printed accurately on it.

As shown in FIGS. 2–4, the motor-driven prestrip roller 50, which has high traction, is driven by the prestrip 52. The prestrip roller 50 is located between the supply roll 16 and the first accumulator carriage 46, downstream from the supply roll 16. The motor 52 drives the prestrip roller 50 which pulls the tape 14 off the supply roll 16 and feeds the tape 14 to the printer 18 at a low controller tension, such as 4.45–22.24 N(1–5 lb). This allows using a printable release agent that typically has either high or jerky unwind characteristics or both. The prestrip roller 50 pulls the tape 14 to the off the supply roll 16, absorbs most of the unwind shock, and presents the tape 14 to the printer at a controlled uniform tension.

The sequence of operation of this aspect of the system 40 is as follows. First, as the second accumulator carriage 42 begins to draw tape (shown in FIG. 2), the printer 18 pulls tape 14 during the print cycle. This pulls down the first accumulator carriage 46 to feed tape into the printer, from a first position as shown in FIG. 3 to a second position as shown in FIG. 4. When the first accumulator carriage 46 moves down sufficiently for the first sensor 48 to detect its presence, the first sensor 48 sends a signal to the controller 60, which can be a separate controller or the same controller used for the sensor 44 at the second accumulator carriage 42. The controller 60 then sends a output signal to turn on the motor 52. The motor 52 drives the prestrip roller 50 which pulls tape 14 off of the supply roll 16. As tape is pulled from the supply roll 16 by the prestrip roller 50, the first accumulator carriage 46 clears the first sensor 48, which no longer sees it, and the sensor sends a signal to the controller 60 to stop the motor 52 from driving the prestrip roller 50 and pulling the tape 14 from the supply roll 16. As the printer 18 pulls more tape, the first accumulator carriage 46 may move down and up several times during the printing of a given tape segment.

The first accumulator carriage 46 is counterbalanced by a force, which can be provided in any suitable way, such as a weight or a spring (not shown), designed to provide the proper tension to the Tape.

In modifications of this system, two sensors 48 can be used. One would start the motor 52 and the other would stop it. In another embodiment, an analog sensor and motor control can be used so that motor speed is determined by the position of the first accumulator carriage 46. Also, a stepper motor can be used to drive the tape at the same rate as demanded by the printer.

The apparatus can operate with a given tape segment that is printed and is not immediately applied onto the next box. The tape segment is wound through a path, such as an accumulator or festoon, because it will be applied to a box that is several boxes upstream at the time immediately following printing. One or more previously printed tape segments must be applied after the given tape segment is printed and before the given tape segment is applied. Alternatively, the apparatus can operate on a "next tape segment out" protocol. That is, after the tape segments are printed, they are not placed in a cue to allow one or more previously printed segments of tape to be applied. In the next tape segment out system, a tape segment is printed and is the next segment to be applied. There is no accumulation of printed tape segments.

Additional features can be used in various combinations with the invention. A ribbon saver feature can stop feeding ribbon when tape is travelling through the printer but long spaces on the tape are not printed. Heat can be used to fuse and anchor ink printed directly on standard box sealing tape backing or on the LAB layer of the backing. Alternatively, ink printed on standard tape can be over-laminated with a clear coat of, for example, a varnish or with a clear tape to protect the ink. These over-laminating processes could facilitate additional printing in or near an area already containing printed information. Also, a plain strip of paper, printed using a low cost wax ribbon or ink jet printing, can be over-laminated with a clear low cost film tape that is wider than the paper strip. The film tape would extend beyond the boundaries of the paper strip and create a printed, pressure sensitive adhesive label.

Various changes and modifications can be made in the invention without departing from the scope or spirit of the invention. For example, although the embodiments shown use thermal ribbon printing, direct thermal, inkjet coding and other printing systems also can be used. The tape can be preprinted with non-variable information, with one or more areas or fields left blank. Variable information can be printed to fill in the blanks. Also, reverse image printing could occur on the adhesive portion of the tape. The disclosures of all patents and patent applications mentioned in this application are incorporated by reference.

What is claimed is:

1. A tape handling system, comprising:

(a) a tape mount roller;

(b) a prestrip roller;

(c) a first accumulator moveable between a first position and a second position;

(d) a printer for printing on tape; and (e) a second accumulator moveable between a first position and a second position, wherein movement of said second accumulator from said first position to said second position causes said printer to begin printing;

wherein said tape handling system includes a tape path from said tape mount roller to said printer, wherein said prestrip roller and said first accumulator are located on said tape path between said tape mount roller and said printer, wherein when said first accumulator is in said first position, said prestrip roller is not driven, and wherein when said first accumulator in said second position, said prestrip roller is driven.

2. The tape handeling system of claim 1, wherein said tape handeling system further comprises:

(f) a first sensor for detecting said first accumulator in said second position, wherein when said first sensor detects said first accumulator in said second position, said prestrip roller is driven.

3. The tape handeling system of claim 2, wherein said tape handeling system further comprises:

(g) a drive motor for driving said prestrip roller; and (h) a first controller, wherein when said first sensor detects said first accumulator in said second position, said first sensor sends a signal to said first controller and thereafter said first controller sends a signal to said drive motor to drive said prestrip roller.

4. The tape handeling system of claim 1, wherein said tape handeling system further comprises:

(f) a second sensor for detecting said second accumulator when it is in said first position.

5. The tape handeling system of claim 1, wherein when said printer has completed printing and said second accumulator is in said second position, said printer continues to feed tape without printing until said second accumulator is in said first position.

6. The tape handling system of claim 1, wherein a roll of linerless pressure sensitive adhesive tape is mounted on said tape mount roller.

7. A tape handling system, comprising:

a) a tape mount roller;

b) a prestrip roller;

c) a first accumulator moveable between a first position and a second position;

d) a printer for printing on tape; and e) a second accumulator moveable between a first position and a second position, wherein movement of said second accumulator from said first position to said second position causes said printer to begin printing;

wherein said tape handling system includes a tape path from said tape mount roller to said printer, wherein said prestrip roller is located along said tape path between said tape mount roller and said first accumulator, and wherein said first accumulator is located along said tape path between said prestrip roller and said printer.

8. The tape handeling system of claim 7, wherein said first accumulator is moveable between a first position and a second position, and wherein when said first accumulator is in said first position, said prestrip roller is not driven, and wherein when said first accumulator in said second position, said prestrip roller is driven.

9. The tape handeling system of claim 8, wherein said tape handeling system further comprises:

(f) a first sensor for detecting said first accumulator in said second position, wherein when said first sensor detects said first accumulator in said second position, said prestrip roller is driven.

10. The tape handeling system of claim 9, wherein said tape handeling system further comprises:

(g) a drive motor for driving said prestrip roller; and (h) a first controller, wherein when said first sensor detects said first accumulator in said second position, said first sensor sends a signal to said first controller and thereafter said first controller sends a signal to said drive motor to drive said prestrip roller.

11. The tape handeling system of claim 7, wherein said tape handeling system further comprises:

(i) a second sensor for detecting said second accumulator when it is in said first position.

12. The tape handeling system of claim 7, wherein when said printer has completed printing and said second accumulator is in said second position, said printer continues to feed tape without printing until said second accumulator is in said first position.

13. The tape handeling system of claim 7, wherein a roll of linerless pressure sensitive adhesive tape is mounted on said tape mount roller.

14. An apparatus including a tape handling system and tape applicator, comprising:

a) a tape handling system, comprising:

i) a tape mount roller;

ii) a prestrip roller;

iii) a first accumulator moveable between a first position and a second position;

iv) a printer for printing on tape; and v) a second accumulator moveable between a first position and a second position, wherein movement of said second accumulator from said first position to said second position causes said printer to begin printing;

wherein said tape handling system includes a tape path from said tape mount roller to said printer, wherein said prestrip roller and said first accumulator are located on said tape path between said tape mount roller and said printer, wherein when said first accumulator is in said first position, said prestrip roller is not driven, and wherein when said first accumulator in said second position, said prestrip roller is driven;

b) a tape cutting mechanism; and c) a tape applying mechanism for applying the tape to an object;

wherein said apparatus includes a tape path from said tape handling system to said tape applying mechanism, and wherein said tape cutting mechanism is located on said tape path between said tape handling systems and said tape applying mechanism.

15. The apparatus of claim 14, wherein said tape handeling system further comprises:

vi) a first sensor for detecting said first accumulator in said second position, wherein when said first sensor detects said first accumulator in said second position, said prestrip roller is driven.

16. The apparatus of claim 15, wherein said tape handeling system further comprises:

vii) a drive motor for driving said prestrip roller; and viii) a first controller, wherein when said first sensor detects said first accumulator in said second position, said first sensor sends a signal to said first controller and thereafter said first controller sends a signal to said drive motor to drive said prestrip roller.

17. The apparatus of claim 14, wherein said tape handeling system further comprises:

vi) a second sensor for detecting said second accumulator when it is in said first position.

18. The apparatus of claim 14, wherein when said printer has completed printing and said second accumulator is in said second position, said printer continues to feed tape without printing until said second accumulator is in said first position.

19. The apparatus of claim 14, wherein a roll of linerless pressure sensitive adhesive tape is mounted on said tape mount roller.

20. The apparatus of claim 14, wherein said tape applying mechanism applies the tape to a box including sides, corners, and seams.

21. The apparatus of claim 20, wherein said tape applying mechanism applies the tape to said seam of said box to seal the box.

22. The apparatus of claim 20, wherein said tape applying mechanism applies the tape to said corner of said box.

23. The apparatus of claim 20, wherein said tape applying mechansism applies the tape to said side of said box.

24. An apparatus including a tape handling system and tape applicator, comprising:

a) a tape handling system, comprising:

i) a tape mount roller;

ii) a prestrip roller;

iii) a first accumulator moveable between a first position and a second position;

iv) a printer for printing on tape; and v) a second accumulator moveable between a first position and a second position, wherein movement of said second accumulator from said first position to said second position causes said printer to begin printing;

wherein said tape handling system includes a tape path from said tape mount roller to said printer, wherein said prestrip roller is located along said tape path between said tape mount roller and said first accumulator, and wherein said first accumulator is located along said tape path between said prestrip roller and said printer;

b) a tape cutter; and c) a tape applicator for applying the tape to an object.

25. The apparatus of claim 24, wherein said first accumulator is moveable between a first position and a second position, and wherein when said first accumulator is in said first position, said prestrip roller is not driven, and wherein when said first accumulator in said second position, said prestrip roller is driven.

26. The apparatus of claim 25, wherein said tape handeling system further comprises:

vi) a first sensor for detecting said first accumulator in said second position, wherein when said first sensor detects said first accumulator in said second position, said prestrip roller is driven.

27. The apparatus of claim 26, wherein said tape handeling system further comprises;

vii) a drive motor for driving said prestrip roller; and viii) a first controller, wherein when said first sensor detect,s said first accumulator in said second position, said first sensor sends a signal to said first controller and thereafter said first controller sends a signal to said drive motor to drive said prestrip roller.

28. The apparatus of claim 24, wherein said tape handeling system further comprises:

vi) a second sensor for detecting said second accumulator when it is in said first position.

29. The apparatus of claim 24, wherein when said printer has completed printing and said second accumulator is in said second position, said printer continues to feed tape without printing until said second accumulator is in said first position.

30. The apparatus of claim 24, wherein a roll of linerless pressure sensitive adhesive tape is mounted on said tape mount roller.

31. The apparatus of claim 24, wherein said tape applicator applies the tape to a box including sides, corners, and seams.

32. The apparatus of claim 31, wherein said a tape applicator applies the tape to said seam of said box to seal the box.

33. The apparatus of claim 31, wherein said tape applicator applies the tape to said corner of said box.

34. The apparatus of claim 31, wherein said tape applicator applies the tape to said side of said box.

* * * * *

UNITED STATES PATENT AND TRADEMARK OFFICE

CERTIFICATE OF CORRECTION

PATENT NO. : 6,415,842 B1
DATED : July 9, 2002
INVENTOR(S) : Vasilakes, Lloyd S.

It is certified that error appears in the above-identified patent and that said Letters Patent is hereby corrected as shown below:

Title page,
Item [56], References Cited, U.S. PATENT DOCUMENTS, please add:
-- 4,909,885 3/1990 Swenson --

Column 1,
Line 50, delete "A" following "is".

Column 2,
Line 28, "Asystem" should read -- A system --.

Column 10,
Lines 23, 29, 30, 37, 38 and 42, "handeling should read -- handling --.

Column 11,
Lines 5, 6, 11, 19, 20, 23, 27, 59 and 65, "handeling" should read -- handling --.

Column 12,
Lines 6, 54 and 60, "handeling" should read -- handling --.
Line 64, "detect,s" should read -- detects --.

Signed and Sealed this

Sixteenth Day of December, 2003

JAMES E. ROGAN
*Director of the United States Patent and Trademark Office*